US010640950B2

(12) United States Patent
Kure et al.

(10) Patent No.: US 10,640,950 B2
(45) Date of Patent: May 5, 2020

(54) OPERATION DEVICE OF WORK VEHICLE

(71) Applicant: KOMATSU LTD., Tokyo (JP)

(72) Inventors: Kazuki Kure, Kishiwada (JP); Hiroki Yamamoto, Kobe (JP); Akane Awazu, Osaka (JP)

(73) Assignee: KOMATSU LTD., Tokyo (JP)

( * ) Notice: Subject to any disclaimer, the term of this patent is extended or adjusted under 35 U.S.C. 154(b) by 166 days.

(21) Appl. No.: 15/117,759

(22) PCT Filed: Feb. 19, 2016

(86) PCT No.: PCT/JP2016/054820
§ 371 (c)(1),
(2) Date: Aug. 10, 2016

(87) PCT Pub. No.: WO2017/141420
PCT Pub. Date: Aug. 24, 2017

(65) Prior Publication Data
US 2018/0067513 A1 Mar. 8, 2018

(51) Int. Cl.
*E02F 9/20* (2006.01)
*G05G 1/58* (2008.04)
*E02F 3/84* (2006.01)

(52) U.S. Cl.
CPC ..... *E02F 9/2004* (2013.01); *G05G 1/58* (2013.01); *E02F 3/84* (2013.01)

(58) Field of Classification Search
CPC ..... G05G 1/58; B60K 37/06; E02F 9/2004
See application file for complete search history.

(56) References Cited

U.S. PATENT DOCUMENTS 4,641,857 A * 2/1987 Gailiunas ..... A63C 11/222 16/DIG. 12
5,577,417 A * 11/1996 Fournier ..... G05G 7/02 414/5
5,957,001 A * 9/1999 Gualtieri ..... B60K 31/00 200/61.88
6,148,593 A * 11/2000 Heinsey ..... G05G 1/01 56/1
6,550,562 B2 * 4/2003 Brandt ..... E02F 9/2004 180/333
6,580,418 B1 * 6/2003 Grome ..... G05G 9/047 345/161
6,648,352 B2 * 11/2003 Felsing ..... B60G 3/14 280/124.128
6,724,366 B2 * 4/2004 Crawford ..... G06F 3/03547 345/156

(Continued)

FOREIGN PATENT DOCUMENTS

EP 1136628 A1 * 9/2001 ..... E02F 9/2004
JP H07-502315 A 3/1995

(Continued)

*Primary Examiner* — Nicole T Verley
(74) *Attorney, Agent, or Firm* — Faegre Drinker Biddle & Reath LLP

(57) ABSTRACT

An operation device includes a hold portion having a base end and a leading end, and an operation portion attached to the leading end of the hold portion. The operation portion includes a finger rest extending substantially along a direction in which the hold portion extends from the base end to the leading end, and first to third operation switches disposed with the finger rest interposed therebetween.

6 Claims, 9 Drawing Sheets

(56) References Cited

U.S. PATENT DOCUMENTS 6,932,183 B2 * 8/2005 Jeppe ..... G05G 1/58 180/333
6,948,398 B2 * 9/2005 Dybro ..... E02F 9/2004 172/170
7,334,658 B2 * 2/2008 Berg ..... B62D 1/12 180/333
7,401,542 B2 * 7/2008 Stephens ..... E02F 9/2004 74/479.01
7,497,298 B2 * 3/2009 Shearer ..... E02F 3/7663 180/333
7,511,236 B2 * 3/2009 Mack ..... G05G 1/01 200/6 A
7,681,686 B1 * 3/2010 Klas ..... B60K 26/00 180/329
7,784,581 B1 * 8/2010 Klas ..... E02F 9/166 180/329
8,028,599 B2 * 10/2011 Mack ..... B60K 20/02 345/161
8,100,218 B2 * 1/2012 Case ..... B62D 1/12 180/315
8,212,770 B2 * 7/2012 Obourn ..... G05G 9/047 345/156
8,276,476 B2 * 10/2012 Diccion ..... E02F 9/2004 180/315
8,434,562 B2 * 5/2013 Miyasaka ..... E02F 5/32 172/431
8,606,463 B2 * 12/2013 Bichler ..... B62D 5/09 180/421
D704,189 S * 5/2014 Rey ..... D14/412
8,746,395 B2 * 6/2014 Frazier ..... E02F 9/2004 180/333
8,893,818 B2 * 11/2014 Hand ..... E02F 3/815 172/812
9,315,103 B2 * 4/2016 Yamauchi ..... B60K 26/02
9,777,461 B2 * 10/2017 Wuisan ..... E02F 3/765
9,791,886 B2 * 10/2017 Ouellette ..... G05G 13/00
9,797,114 B2 * 10/2017 Maifield ..... E02F 9/2004
2002/0166267 A1 * 11/2002 McGugan ..... E02F 3/76 37/348
2013/0133469 A1 * 5/2013 Rey ..... G05G 1/06 74/558.5
2013/0205934 A1 * 8/2013 Schwenk ..... A01D 43/08 74/494
2016/0009174 A1 * 1/2016 Yamauchi ..... B60K 26/02 74/473.3
2016/0145828 A1 * 5/2016 French ..... E02F 3/844 172/667
2017/0031382 A1 * 2/2017 Niguet ..... G05G 9/047

FOREIGN PATENT DOCUMENTS

JP 2002-073187 A 3/2002
WO WO-94/09216 A1 4/1994

* cited by examiner

OPERATION DEVICE OF WORK VEHICLE

TECHNICAL FIELD

The present invention relates to an operation device of a work vehicle.

BACKGROUND ART

Japanese National Patent Publication No. 7-502315 (PTD 1) discloses a steering device of a work vehicle in which the steering device includes a pair of levers to be operated by fingers of an operator, and a handrest for supporting the heel of an operator's palm, and is capable of stably holding the operator's hand even when the work vehicle is traveling on a rough terrain.

CITATION LIST

Patent Document

PTD 1: Japanese National Patent Publication No. 7-502315

SUMMARY OF INVENTION

Technical Problem

The operation device of the work vehicle is required to be further improved in operability. The operability of the conventional operation device is not necessarily sufficient, and there still remains room for improvement.

An object of the present invention is to provide an operation device of a work vehicle enabling a further improvement of the operability.

Solution to Problem

An operation device of a work vehicle according to an aspect of the present invention includes a hold portion and an operation portion. The hold portion includes a base end attached to the work vehicle and a leading end opposite to the base end. The operation portion is attached to the leading end. The operation portion includes: a finger rest extending substantially along a direction in which the hold portion extends from the base end to the leading end; and a plurality of operation switches disposed with the finger rest interposed between the switches.

Regarding the operation device, at least one of one side and the other side between which the finger rest is interposed includes at least two operation switches among the plurality of operation switches. A minimum value of a dimension of the finger rest in a direction orthogonal to a direction in which the finger rest extends is larger than a minimum value of a distance between the at least two switches.

Regarding the operation device, the plurality of operation switches each have an operation face. A minimum value of a dimension of the finger rest in a direction orthogonal to a direction in which the finger rest extends is larger than a minimum value of a transverse length passing through a center of the operation face of each of the plurality of operation switches.

Regarding the operation device, the finger rest has one shape selected from the group consisting of depression, groove, grain, and step formed in a surface of the operation portion.

Regarding the operation device, the finger rest includes a portion formed lower than a top end of the hold portion.

Regarding the operation device, the finger rest is formed at a position crossing a line connecting a center of the base end of the hold portion and a center of the leading end of the hold portion, when the hold portion is seen from a side where the finger rest is formed in the operation portion.

Regarding the operation device, the plurality of operation switches include a first operation switch, a second operation switch disposed below the first operation switch, and a third operation switch disposed below the second operation switch. The first operation switch, the second operation switch, and the third operation switch are arranged on an arc having a center at the leading end of the hold portion as seen from a side where the first operation switch, the second operation switch, and the third operation switch are mounted.

Regarding the operation device, the third operation switch is disposed at a shorter distance from the center of the arc than a distance from the center to the first operation switch and than a distance from the center to the second operation switch.

Regarding the operation device, the operation portion includes one surface on one side and the other surface on the other side with the finger rest interposed between the one side and the other side. On each of the one surface and the other surface, at least one of the plurality of operation switches is mounted. The one surface is inclined with respect to the other surface so that a dimension of a portion protruding from the other surface increases as a distance from the hold portion increases.

Regarding the operation device, a protrusion is formed at the base end of the hold portion, the protrusion being a surface of the base end protruding toward a side from which the hold portion is seen when the operation device is seen from a side where the finger rest is formed in the operation portion.

An operation device of a work vehicle according to an aspect of the present invention includes: a hold portion configured to be held in a palm of one hand of an operator operating the operation device; and an operation portion attached to a leading end of the hold portion. The operation portion includes at least three operation switches to be operated by a finger of the operator. The at least three operation switches are arranged on an arc having a center at the leading end of the hold portion as seen from a side where the at least three operation switches are arranged. One of the at least three operation switches is disposed at a shorter distance from the center of the arc than a distance from the center to other operation switches of the at least three operation switches.

An operation device of a work vehicle according to an aspect of the present invention includes: a hold portion configured to be held in a palm of one hand of an operator operating the operation device; and an operation portion attached to a leading end of the hold portion. The operation portion includes: a plurality of operation switches to be operated by a finger of the operator; and a finger rest formed between the plurality of switches for allowing the finger of the operator operating the operation switches to rest on the finger rest.

Advantageous Effects of Invention

The operation device of a work vehicle of the present invention enables a further improvement of the operability.

DESCRIPTION OF EMBODIMENTS

In the following, embodiments of the present invention will be described based on the drawings.

Initially, a description will be given of a configuration of a bulldozer as an example of a work vehicle to which the concept of the present invention is applicable.

Figure 1:
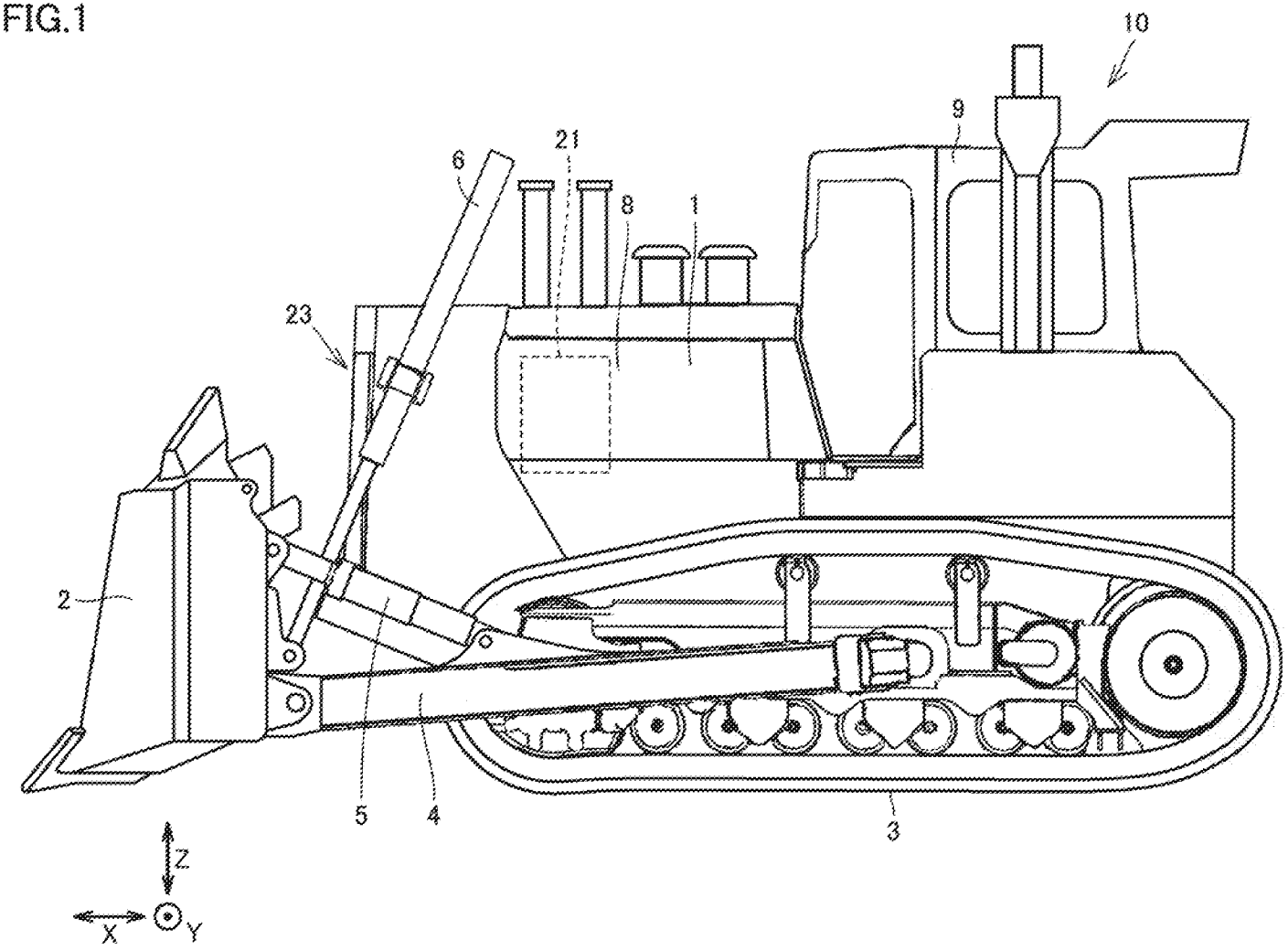
FIG. 1 is a side view schematically showing a configuration of a bulldozer in one embodiment of the present invention.

FIG. 1 is a side view schematically showing a configuration of a bulldozer 10 in one embodiment of the present invention. As shown in FIG. 1, bulldozer 10 of the present embodiment mainly includes a vehicular body 1, a blade 2, and a traveling device. The traveling device has a pair of right and left crawler type carriers 3 separated from each other in the vehicular width direction. Vehicular body 1 is disposed between the paired right and left crawler type carriers 3. Blade 2 is disposed at a frontward position of vehicular body 1.

Vehicular body 1 has a cab (operator's cab) 9 and an engine compartment 8. Cab 9 is disposed in an upper rear portion of vehicular body 1. An operator operating bulldozer 10 is aboard cab 9. Cab 9 has, in its inside, an operator's seat for an operator to sit, and is configured to surround the operator's seat. Engine compartment 8 is disposed frontward of cab 9. Engine compartment 8 is disposed between cab 9 and blade 2. In engine compartment 8, an engine 21 is housed.

In the present embodiment, the direction in which bulldozer 10 travels straight forward is referred to as front-rear direction of bulldozer 10. In the front-rear direction of bulldozer 10, the direction in which blade 2 protrudes from vehicular body 1 is referred to as frontward direction. In the front-rear direction of bulldozer 10, the direction opposite to the frontward direction is referred to as rearward direction. The right-left direction of bulldozer 10 is the direction orthogonal to the front-rear direction as seen in plan view. From the viewpoint in the frontward direction, the right side and the left side in the right-left direction are respectively rightward direction and leftward direction. The top-bottom direction of bulldozer 10 is the direction orthogonal to a plane defined by the front-rear direction and the right-left direction. In the top-bottom direction, the ground side is lower side and the sky side is upper side.

The front-rear direction is the front-rear direction with respect to an operator sitting on the operator's seat in cab 9. The right-left direction is the right-left direction with respect to an operator sitting on the operator's seat. The right-left direction is the vehicular width direction of bulldozer 10. The top-bottom direction is the top-bottom direction with respect to an operator sitting on the operator's seat. The direction in which an operator sitting on the operator's seat faces is the frontward direction, and the backward direction with respect to an operator sitting on the operator's seat is the rearward direction. The right side and the left side with respect to an operator sitting on the operator's seat and facing frontward are respectively the rightward direction and the leftward direction. The feet side and the head side of an operator sitting on the operator's seat are respectively the lower side and the upper side.

In the following drawings, the front-rear direction is indicated by an arrow X, the right-left direction is indicated by an arrow Y, and the top-bottom direction is indicated by an arrow Z.

Bulldozer 10 includes blade 2 located frontward as a work implement. Blade 2 is a work implement for performing work such as excavating earth and sand and grading. Blade 2 is supported at each of its right side and left side by a frame 4. Frame 4 is a member in the shape of a quadrangular prism. One end of frame 4 is attached to the back surface of blade 2 by a rotatable support. The other end of frame 4 is supported on a side surface of the traveling device.

Blade 2 is actuated by a tilt cylinder 5 and a lift cylinder 6. One end of tilt cylinder 5 is supported on the back surface of blade 2. The other end of tilt cylinder 5 is supported on the upper surface of frame 4. Tilt cylinder 5 is extended/contracted by hydraulic pressure to cause the top end of blade 2 to move in the front-rear direction about the support with which frame 4 is attached to blade 2. Accordingly, the tilt angle of blade 2 is changed.

One end of lift cylinder 6 is supported on the back surface of blade 2. An intermediate portion of lift cylinder 6 is supported on a side surface of vehicular body 1. Lift cylinder 6 is extended/contracted by hydraulic pressure to cause blade 2 to move in the top-bottom direction about the other end of frame 4.

Bulldozer 10 may include a ripper device behind vehicular body 1 as another work implement.

A front grille 23 is attached to vehicular body 1. Front grille 23 is disposed at the front end of vehicular body 1. Front grille 23 is disposed to cover an opening formed at the front end of vehicular body 1. Blade 2 is disposed frontward of and spaced from front grille 23.

Figure 2:
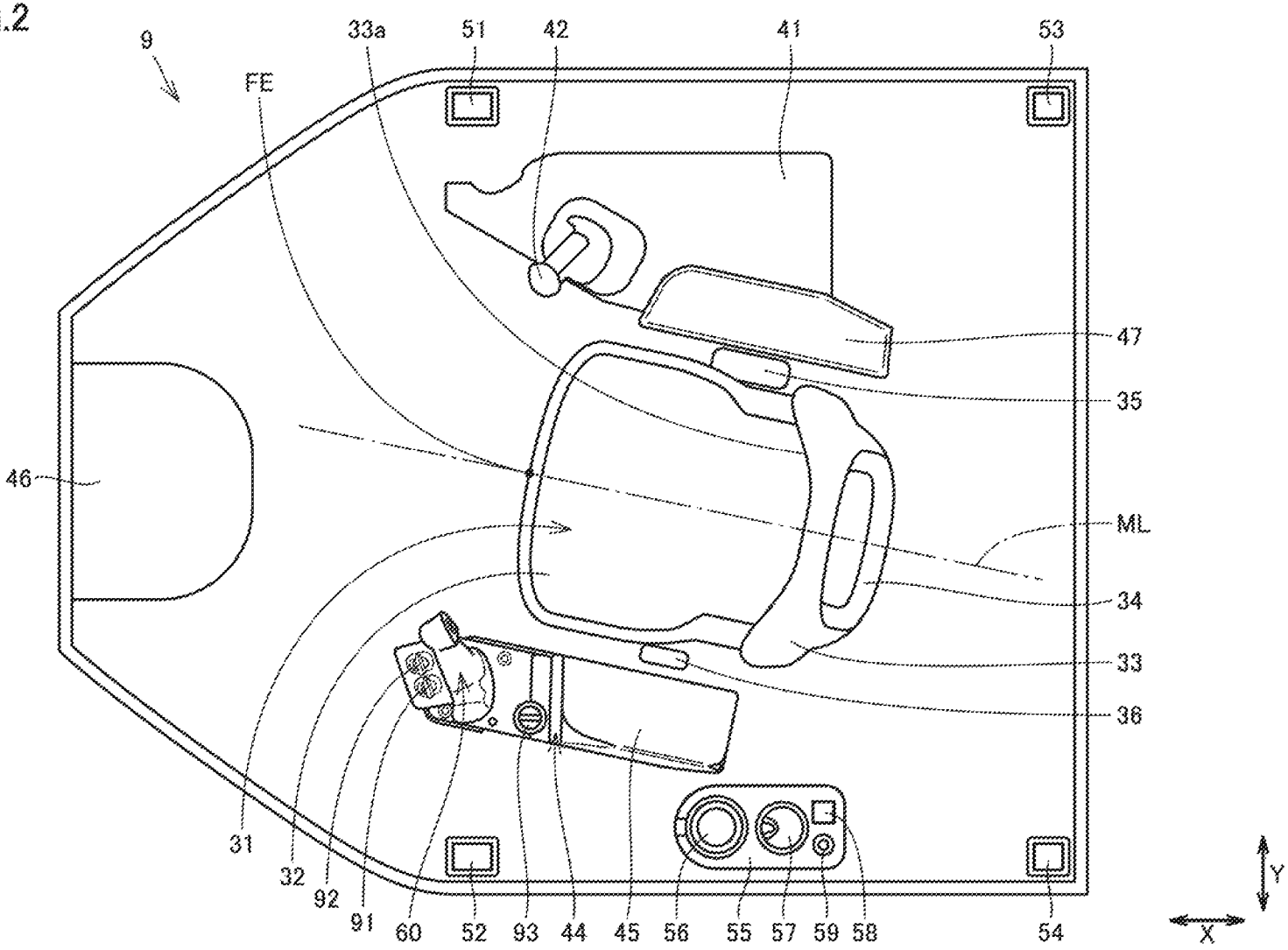
FIG. 2 is a plan view schematically showing a configuration of an inside of a cab shown in FIG. 1.

FIG. 2 is a plan view schematically showing a configuration of an inside of cab 9. As shown in FIG. 2, an operator's seat 31 is disposed inside cab 9. Cab 9 has a roof portion disposed to cover operator's seat 31 and a plurality of pillars supporting the roof portion. Each pillar extends in the top-bottom direction (Z direction) and is coupled to the floor portion and the roof portion of cab 9.

The plurality of pillars include front pillars 51, 52 and rear pillars 53, 54. Front pillars 51, 52 are disposed frontward in the front-rear direction (X direction) with respect to operator's seat 31. Rear pillars 53, 54 are disposed rearward in the front-rear direction (X direction) with respect to operator's seat 31. Front pillar 51 and rear pillar 53 are disposed rightward in the vehicular width direction (Y direction) with respect to operator's seat 31. Front pillar 52 and rear pillar 54 are disposed leftward in the vehicular width direction (Y direction) with respect to operator's seat 31.

Operator's seat 31 is disposed substantially at the center of cab 9. Operator's seat 31 has a seat portion 32, a back portion 33, and a headrest 34. An operator aboard cab 9 sits on seat portion 32. Back portion 33 is provided for the operator sitting on seat portion 32 to rest the operator's back on the back portion. A side support protruding frontward is provided at each of the right end and the left end of back portion 33 so as to immovably support the sitting operator.

To the top end of back portion 33, headrest 34 is attached. Headrest 34 protects the head of the operator from impact.

The dot-and-dash line in FIG. 2 indicates a median line ML of operator's seat 31. The median line is a virtual line dividing operator's seat 31 into a right half and a left half. When operator's seat 31 is seen from the front, median line ML passes through the center in the lateral direction of operator's seat 31. When operator's seat 31 is seen from the back, median line ML passes through the center in the lateral direction of operator's seat 31. In the plan view shown in FIG. 2, median line ML passes through the center of operator's seat 31 and extends along the position dividing operator's seat 31 into equal parts.

In the case where operator's seat 31 is bilaterally symmetrical in shape, median line ML is located on the plane of symmetry. However, operator's seat 31 of the present embodiment may not be completely symmetrical. Median line ML may be a line dividing, into equal parts, a bilaterally symmetrical member which forms a part of operator's seat 31. Median line ML may also be a line dividing, into equal parts, a bilaterally symmetrical part of a member which forms a part of operator's seat 31. For example, median line ML may be a line dividing seat portion 32 into equal parts, a line dividing back portion 33 into equal parts, a line dividing a front surface 33*a* of the back portion into equal parts, or a line dividing headrest 34 into equal parts.

As shown in FIG. 2, median line ML of operator's seat 31 extends to incline with respect to the front-rear direction (X direction) of cab 9, so that median line ML inclines rightward toward the front and inclines leftward toward the back. Operator's seat 31 is fixed in cab 9, so that a front edge FE of operator's seat 31 inclines rightward with respect to the front-rear direction (X direction) of cab 9 as seen in plan view. Front edge FE is a front end portion of operator's seat 31 and this front end portion is located on median line ML as seen in plan view.

A front console 46 is disposed frontward of operator's seat 31 in cab 9. To front console 46, a control panel, gauges, switches, and the like are attached.

On the right side of operator's seat 31 in cab 9, a right console 41 is disposed. On right console 41, a lever for controlling the work implement is provided. To right console 41, a blade control lever 42 for controlling blade 2 is attached. Blade control lever 42 is disposed at a front portion of right console 41.

On the right side of operator's seat 31 in cab 9, a right armrest 47 is disposed. Right armrest 47 is disposed laterally with respect to operator's seat 31. In the vehicular width direction (Y direction), right armrest 47 is disposed between operator's seat 31 and right console 41.

On the right side of operator's seat 31 in cab 9, a belt housing 35 for housing a seat belt is disposed. Belt housing 35 is disposed between operator's seat 31 and right armrest 47. On the left side of operator's seat 31 in cab 9, a latch portion 36 for latching the seat belt is disposed. Latch portion 36 is disposed between operator's seat 31 and a left console 44. The seat belt is pulled from belt housing 35 and latching hardware at the leading end of the seat belt is engaged with latch portion 36 to place the seat belt on the waist of an operator sitting on operator's seat 31.

On the left side of operator's seat 31 in cab 9, a side shelf 55 is disposed. Side shelf 55 is disposed laterally with respect to operator's seat 31. On side shelf 55, a cup holder 56, an ashtray 57, a cigarette lighter 58, and an external connection terminal 59 are provided. Cup holder 56, ashtray 57, cigarette lighter 58, and external connection terminal 59 constitute a handled portion to be handled by an operator sitting on operator's seat 31.

On the left side of operator's seat 31 in cab 9, left console 44 is disposed. Left console 44 is substantially rectangular in shape as seen in plan view. The longer sides of the substantially rectangular shape extend in parallel with median line ML of operator's seat 31. The direction in which left console 44 extends as seen in plan view is the direction in parallel with the direction in which median line ML of operator's seat 31 extends.

On left console 44, an operation device 60 for controlling forward travel and backward travel of bulldozer 10 is provided. Operation device 60 is disposed at a front portion of left console 44. A rear portion of left console 44 is provided to serve as a left armrest 45. Operation device 60 is disposed frontward of left armrest 45 and spaced from left armrest 45. Operation device 60 is disposed to incline obliquely as seen in plan view. The angle at which the direction in which operation device 60 extends in plan view is inclined with respect to the line orthogonal to median line ML is smaller than the angle at which median line ML inclines with respect to the front-rear direction.

Operation levers 91, 92 are disposed frontward of operation device 60. Operation levers 91, 92 are attached to a front end of left console 44. Operation lever 91 is an operation device for controlling rotation of the left crawler of the pair of right and left crawler type carriers 3 (FIG. 1). Operation lever 92 is an operation device for controlling rotation of the right crawler of the pair of right and left crawler type carriers 3. Operation levers 91, 92 constitute a steering device for performing steering of bulldozer 10.

Between operation device 60 and left armrest 45 of left console 44, a fuel dial 93 for setting the rpm of engine 21 (FIG. 1) is disposed.

Figure 3:
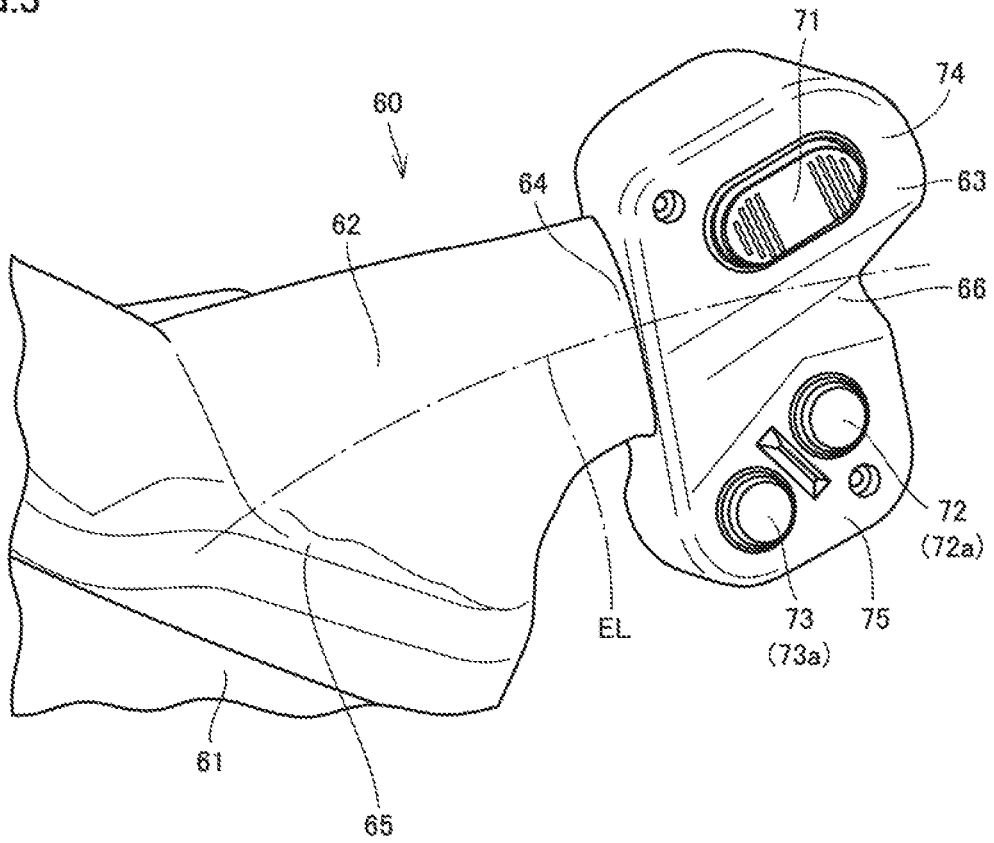
FIG. 3 is a perspective view schematically showing a configuration of an operation device of the bulldozer.
Figure 4:
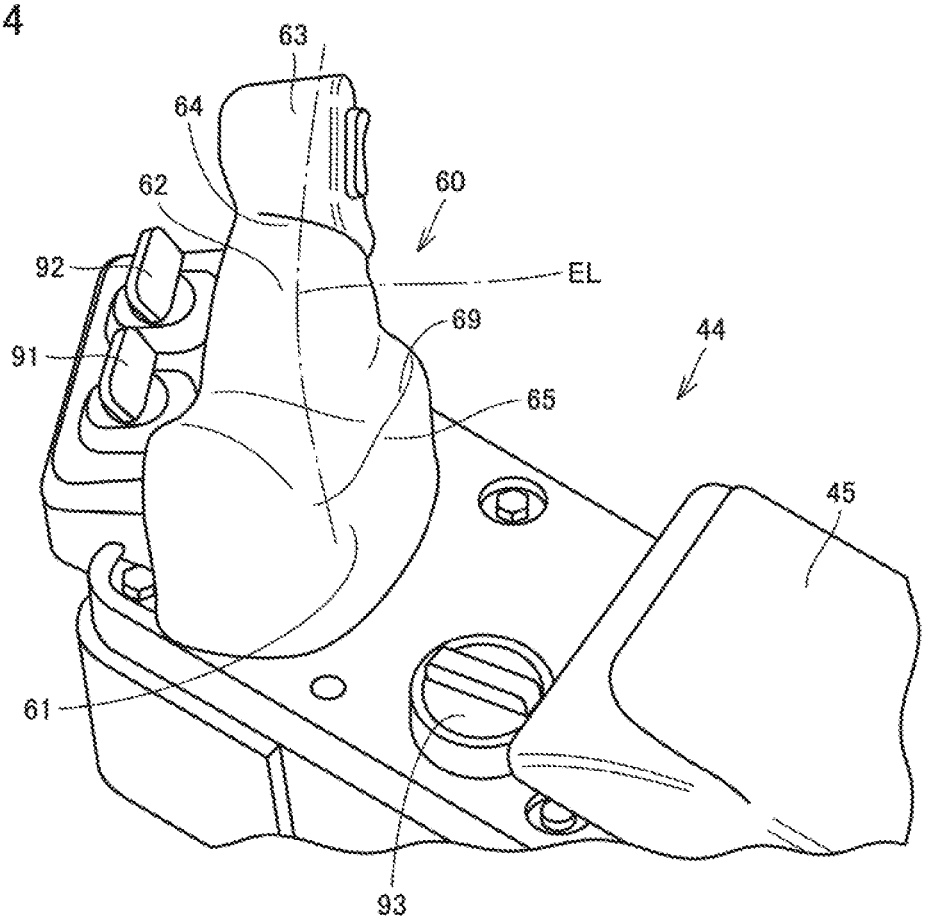
FIG. 4 is a perspective view of the operation device as seen at a different angle.
Figure 5:
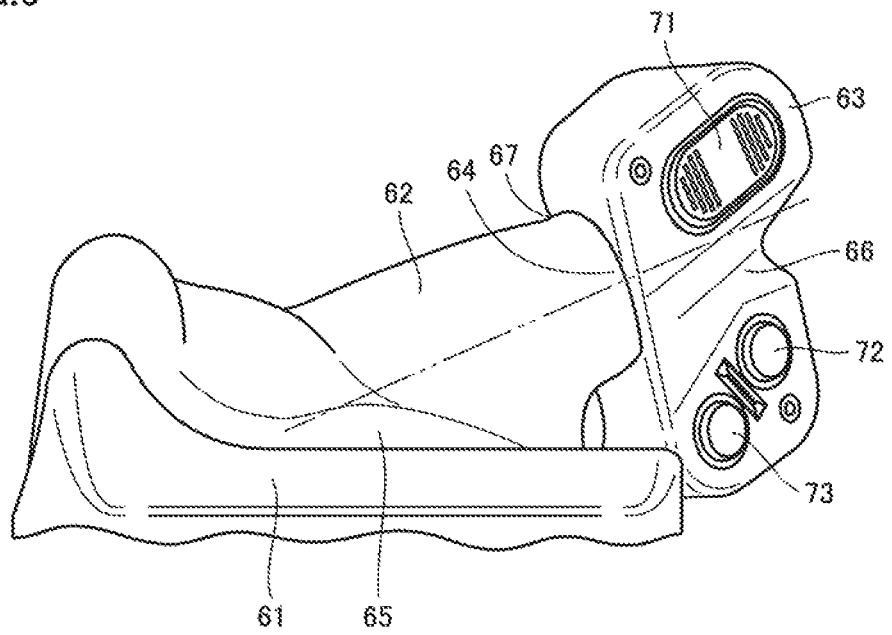
FIG. 5 is a diagram of the operation device as seen along the direction in which a left console extends.

FIG. 3 is a perspective view schematically showing a configuration of operation device 60 of bulldozer 10. FIG. 4 is a perspective view of operation device 60 as seen at a different angle. FIG. 5 is a diagram of operation device 60 as seen along the direction in which left console 44 extends. As shown in FIGS. 3, 4, and 5, operation device 60 mainly includes a base portion 61, a hold portion 62, and an operation portion 63. Base portion 61 is fixed to left console 44. Base portion 61 is disposed to protrude upward from the upper surface of left console 44.

Hold portion 62 is fixed to the top end of base portion 61. Hold portion 62 extends to incline with respect to the front-rear direction, the right-left direction, and the top-bottom direction. As shown in FIGS. 2 and 4, hold portion 62 as seen in plan view inclines with respect to the front-rear direction and the right-left direction so that hold portion 62 extends frontward toward the right. As shown in FIGS. 4 and 5, hold portion 62 as seen in the front-rear direction inclines with respect to the top-bottom direction and the right-left direction so that hold portion 62 extends upward toward the right. In the surface of hold portion 62, a grain shape defined by minute projections and depressions may be formed.

Hold portion 62 has a leading end 64 and a base end 65. Base end 65 is one of the opposite ends of hold portion 62 that is attached to base portion 61. Base end 65 of hold portion 62 is attached to left console 44 via base portion 61. Base end 65 of hold portion 62 is attached to cab 9 via base portion 61 and left console 44. Leading end 64 is the other end of hold portion 62 that is opposite to base end 65. Leading end 64 is an end of hold portion 62 located away from base portion 61.

Leading end 64 forms the front end of hold portion 62 in the front-rear direction, forms the right end of hold portion 62 in the right-left direction, and forms the top end of hold portion 62 in the top-bottom direction. Hold portion 62 is shaped to extend rightward, frontward, and upward, from base end 65 to leading end 64. The top surface of hold portion 62 shown in FIG. 2 inclines rearward and downward from leading end 64 to base end 65. The top surface of hold portion 62 inclines from base end 65 toward the top.

The curved two-dot chain line shown in FIGS. 3 and 4 represents a direction EL in which hold portion 62 extends from base end 65 to leading end 64. Direction EL in which hold portion 62 extends is a direction in which a line which connects the center of leading end 64 of hold portion 62 and the center of base end 65 thereof extends, when hold portion 62 is seen in any direction in which both leading end 64 and base end 65 can be seen. In the plan view shown in FIG. 2, direction EL in which hold portion 62 extends inclines with respect to the front-rear direction and the right-left direction so that direction EL extends frontward toward the right and rearward toward the left.

Operation portion 63 is attached to leading end 64 of hold portion 62 and fixed to hold portion 62. Base portion 61, hold portion 62, and operation portion 63 are formed integrally with left console 44. Base portion 61, hold portion 62, and operation portion 63 are provided immovably with respect to left console 44. Operation portion 63 is supported like a cantilever via hold portion 62.

Operation portion 63 has a plurality of operation switches 71 to 73. A plurality of operation switches 71 to 73 are mounted on a part of the surface of operation portion 63 that faces the body trunk of an operator in the state of sitting on the operator's seat shown in FIG. 2.

Among three operation switches 71 to 73, first operation switch 71 is disposed at an uppermost position. Second operation switch 72 is disposed below first operation switch 71. Third operation switch 73 is disposed below second operation switch 72. Second operation switch 72 is disposed between first operation switch 71 and third operation switch 73 in the top-bottom direction. Among three operation switches 71 to 73, third operation switch 73 is disposed at a lowermost position.

First operation switch 71 is a switch for making a switch between the forward travel and the backward travel of bulldozer 10. When an operator operates first operation switch 71 with a finger, the setting of the direction of travel of bulldozer 10 is switched to forward travel, backward travel, or neutral. First operation switch 71 may be a rocker switch. In this case, the operation face of first operation switch 71 may be configured so that the operation face of first operation switch 71 is tilted toward one side to thereby set the direction of travel to forward travel, the operation face of first operation switch 71 is tilted toward the other side to thereby set the direction of travel to backward travel, and the operation face of first operation switch 71 is located at a neutral position where the operation face is neither tilted toward the one side nor tilted toward the other side, to thereby set the direction of travel to neutral.

Second and third operation switches 72, 73 are switches for shifting gears of a transmission of bulldozer 10. Second operation switch 72 is a switch for shifting into a higher gear of the transmission. When an operator operates second operation switch 72 with a finger, the gears of the transmission are shifted from a lower gear into a higher gear. Third operation switch 73 is a switch for shifting into a lower gear of the transmission. When an operator operates third operation switch 73 with a finger, the gears of the transmission are shifted from a higher gear into a lower gear.

Second operation switch 72 and third operation switch 73 may each be a push button switch. Second operation switch 72 has an operation face 72*a* protruding from the surface of operation portion 63, and third operation switch 73 has an operation face 73*a* protruding from the surface of operation portion 63 (see also FIG. 8 described later herein). Operation face 72*a* of second operation switch 72 and operation face 73*a* of third operation switch 73 each have a circular shape. A plurality of operation switches 71 to 73 include at least one circular switch having a circular operation face.

The surface of operation portion 63 has one flat surface 74 and the other flat surface 75. First operation switch 71 is mounted on one surface 74. Second operation switch 72 and third operation switch 73 are mounted on the other surface 75. One surface 74 and the other surface 75 constitute a switch mount surface where a plurality of operation switches 71 to 73 are mounted. On one surface 74 and the other surface 75 each, at least one of a plurality of operation switches 71 to 73 is mounted. One surface 74 has one of a plurality of operation switches 71 to 73, namely first operation switch 71. The other surface 75 has two of a plurality of operation switches 71 to 73, namely second operation switch 72 and third operation switch 73.

Between one surface 74 and the other surface 75, a finger rest 66 is formed. Finger rest 66 is formed between a plurality of operation switches. Finger rest 66 is formed between first operation switch 71, and second and third operation switches 72, 73. A plurality of operation switches 71 to 73 are disposed with finger rest 66 interposed therebetween. Finger rest 66 has a shape depressed with respect to one surface 74 and the other surface 75. Finger rest 66 has a depressed shape formed in the surface of operation portion 63. Finger rest 66 is formed in a part of the surface of operation portion 63 that faces the body trunk of an operator in the state of sitting on the operator's seat shown in FIG. 2.

Finger rest 66 extends substantially along direction EL in which hold portion 62 extends. Herein, the condition that the direction in which finger rest 66 extends is identical to direction EL in which hold portion 62 extends, or is in parallel with the direction in which hold portion 62 extends, or is inclined with respect to direction EL in which hold portion 62 extends but the angle of inclination is small, is encompassed by the condition that finger rest 66 extends substantially along direction EL in which hold portion 62 extends. The condition that the angle formed between the direction in which finger rest 66 extends and direction EL in which hold portion 62 extends is for example 45° or less, preferably 30° or less, may be defined as the condition that finger rest 66 extends substantially along direction EL in which hold portion 62 extends.

FIG. 5 shows a top end 67 of hold portion 62. In the top-bottom direction, finger rest 66 has a portion formed lower than the top end of hold portion 62. The two-dot chain line shown in FIG. 5 represents a virtual line connecting the center of leading end 64 and the center of base end 65, when hold portion 62 is seen from the side where finger rest 66 is formed in operation portion 63. Finger rest 66 is formed at a position crossing the two-dot chain line shown in FIG. 5.

As shown in FIG. 4, at base end 65 of hold portion 62, a protrusion 69 is formed that is a smooth protrusion of the surface of base end 65. When operation device 60 is seen from the side where finger rest 66 is formed in operation portion 63, protrusion 69 protrudes toward the side from which hold portion 62 is seen. Protrusion 69 protrudes in the direction of approaching the body trunk of an operator in the state of sitting on the operator's seat shown in FIG. 2. Since protrusion 69 is formed, a smooth depression of the surface of hold portion 62 is formed directly on protrusion 69.

Figure 6:
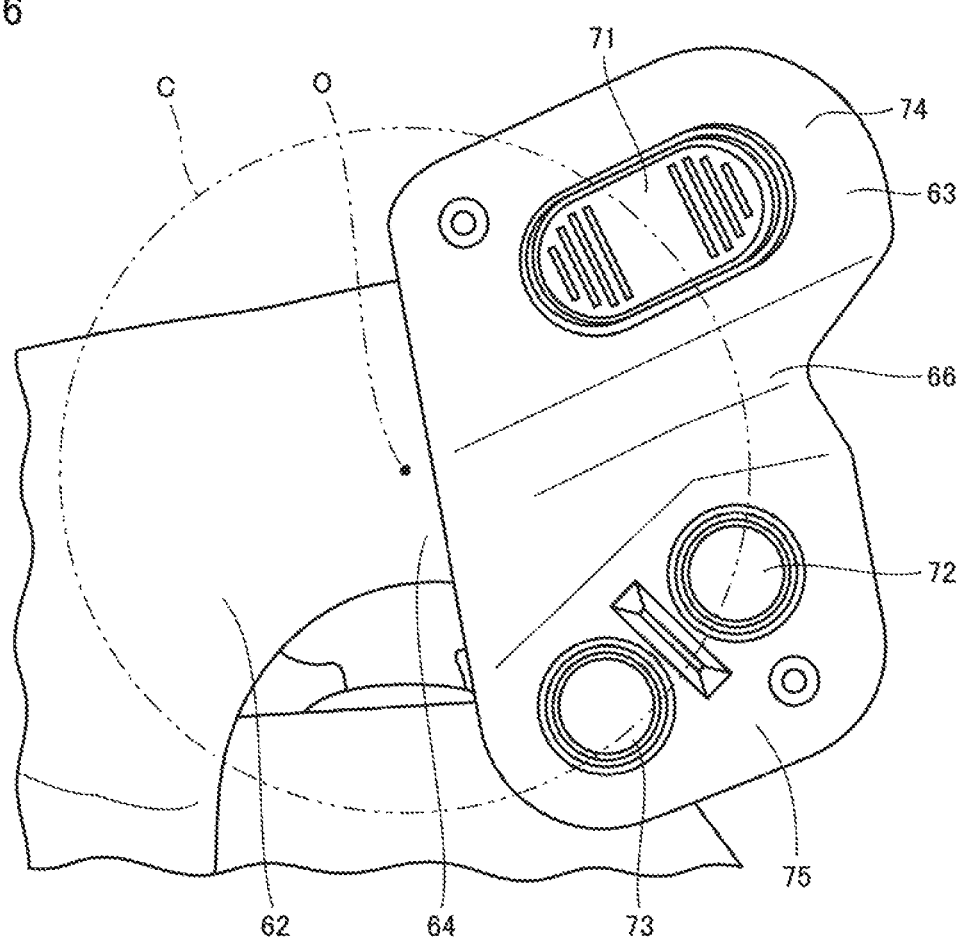
FIG. 6 is an enlarged diagram of a leading end of a hold portion and an operation portion of the operation device.

FIG. 6 is an enlarged diagram of leading end 64 of hold portion 62 and operation portion 63 of operation device 60. A circle C represented by the two-dot chain line in FIG. 6 represents a virtual circle passing through all of first to third operation switches 71 to 73. A center O shown in FIG. 6 represents the center of circle C. Center O is located at leading end 64 of hold portion 62 when operation device 60 is seen from the side where first to third operation switches 71 to 73 are mounted on operation portion 63. First operation switch 71, second operation switch 72, and third operation switch 73 are arranged on circle C. First to third operation switches 71 to 73 are arranged in the circumferential direction of circle C.

Circle C passes through a central portion of first operation switch 71. Circle C passes through a central portion of second operation switch 72. Circle C does not pass through a central portion of third operation switch 73 and the central portion of third operation switch 73 is located inside circle C. Third operation switch 73 is disposed at a shorter distance from center O of circle C than the distance from center O to first operation switch 71 and than the distance from center O to second operation switch 72.

Figure 7:
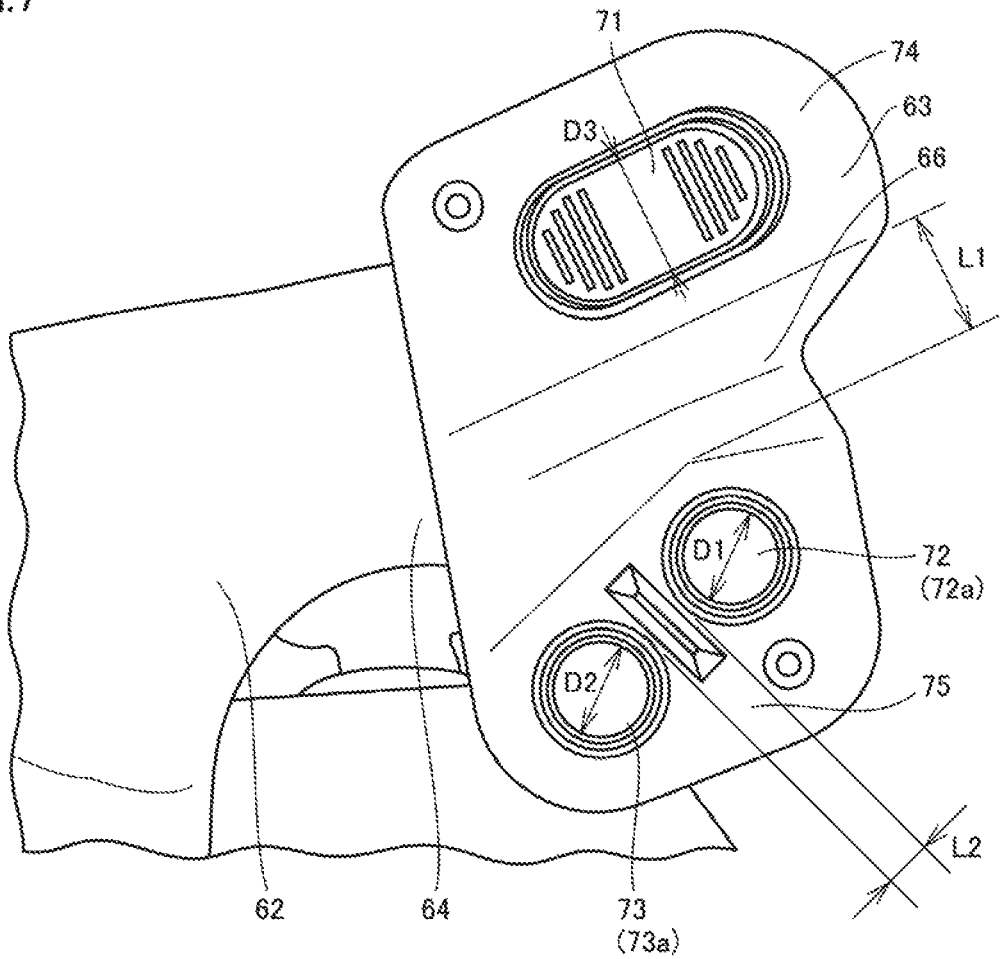
FIG. 7 is a diagram illustrating a relation between a dimension of a finger rest and operation switches.

FIG. 7 is a diagram illustrating a relation between the dimension of finger rest 66 and operation switches. FIG. 7 shows operation portion 63 as seen at the same angle as FIG. 6. A length L1 shown in FIG. 7 represents the minimum value of the dimension of finger rest 66 opened on the surface of operation portion 63, in the direction orthogonal to the direction in which finger rest 66 extends. A length L2 represents the minimum value of the distance between second operation switch 72 and third operation switch 73. A diameter D1 represents the diameter of circular operation face 72*a* of second operation switch 72. A diameter D2 represents the diameter of circular operation face 73*a* of third operation switch 73. A minor axis D3 represents the minimum length among transverse lengths passing through the center of the operation face of first operation switch 71.

As shown in FIG. 7, length L1 is larger than length L2. The minimum value of the dimension of finger rest 66 in the direction orthogonal to the direction in which finger rest 66 extends is larger than the minimum value of the distance between second operation switch 72 and third operation switch 73.

Diameter D1 of operation face 72*a* of second operation switch 72 may be regarded as a transverse length passing through the center of circular operation face 72*a*. Since operation face 72*a* is circular, diameter D1 may be regarded as the minimum value of the transverse length passing through the center of operation face 72*a*. Diameter D2 of operation face 73*a* of third operation switch 73 may be regarded as a transverse length passing through the center of circular operation face 73*a*. Since operation face 73*a* is circular, diameter D2 may be regarded as the minimum value of the transverse length passing through the center of operation face 73*a*.

Length L1 is larger than each of diameters D1, D2 and minor axis D3. The minimum value of the dimension of finger rest 66 in the direction orthogonal to the direction in which finger rest 66 extends is larger than minor axis D3 which is the minimum value of the transverse length passing through the center of the operation face of first operation switch 71, larger than diameter D1 which is the minimum value of the transverse length passing through the center of operation face 72*a* of the second operation switch, and larger than diameter D2 which is the minimum value of the transverse length passing through the center of operation face 73*a* of third operation switch 73. The minimum value of the dimension of finger rest 66 in the direction orthogonal to the direction in which finger rest 66 extends is larger than the minimum value of the transverse length passing through the center of the operation face of each of a plurality of operation switches.

Figure 8:
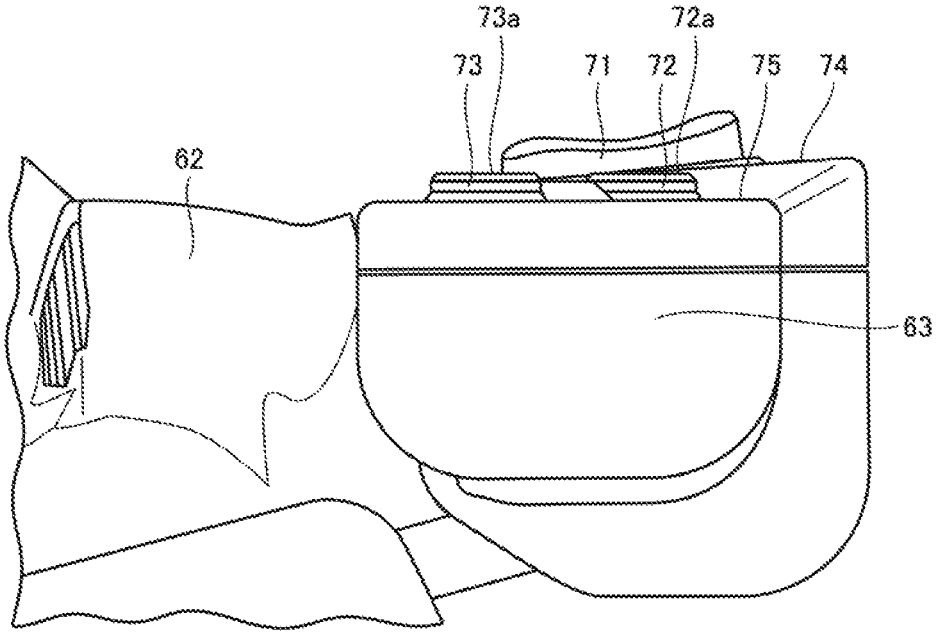
FIG. 8 is a diagram of the operation device as seen in a direction substantially orthogonal to a switch mount surface.

FIG. 8 is a diagram of operation device 60 as seen in a direction substantially orthogonal to the switch mount surface. In FIG. 8, one surface 74 on which first operation switch 71 is mounted and the other surface 75 on which second and third operation switches are mounted are shown one-dimensionally. In FIG. 8, operation device 60 is shown as seen in the direction orthogonal to the direction in which one surface 74 extends and orthogonal to the direction in which the other surface 75 extends.

In FIG. 8, one surface 74 and the other surface 75 are shown separately. One surface 74 and the other surface 75 are not coplanar and form respective planes different from each other. In FIG. 8, one surface 74 extends in the right-left direction as seen in FIG. 8. In FIG. 8, the other surface 75 extends to incline upward toward the right as seen in FIG. 8. As shown in FIG. 8, one surface 74 inclines with respect to the other surface 75 so that the dimension of a portion protruding from the other surface 75 increases as the distance from hold portion 62 increases.

Figure 9:
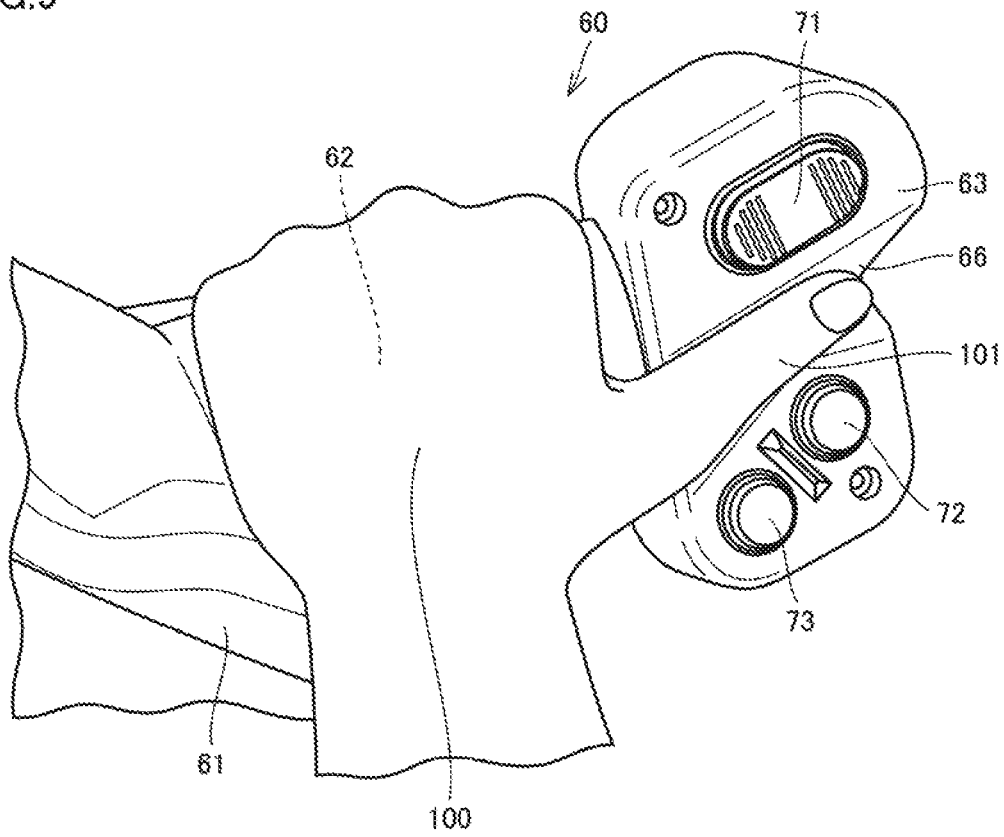
FIG. 9 is a perspective view showing a state in which an operator holds the operation device.

FIG. 9 is a perspective view showing a state in which an operator holds operation device 60. Hold portion 62 is configured to be held in the palm of left hand 100 of an operator operating operation device 60. First to third operation switches 71 to 73 are configured to be operable by thumb 101 of left hand 100 of the operator. Finger rest 66 is configured to enable thumb 101 to rest on finger rest 66 while the operator does not operate a plurality of operation switches 71 to 73.

Next, functions and effects of the present embodiment will be described.

Operation device 60 of bulldozer 10 of the present embodiment includes operation portion 63 as shown in FIGS. 3 to 8. Operation portion 63 has first to third operation switches 71 to 73 to be operated by a finger of an operator, and finger rest 66. Finger rest 66 extends substantially along the direction in which hold portion 62 extends from base end 65 to leading end 64. Finger rest 66 is configured to enable thumb 101 of an operator to rest on. Finger rest 66 is formed between first operation switch 71 and second and third operation switches 72, 73. First to third operation switches 71 to 73 are disposed with finger rest 66 interposed between the switches.

An operator operating operation device 60 manipulates first to third operation switches 71 to 73 with thumb 101 of left hand 100. Since first to third operation switches 71 to 73 are disposed at the position which is easy to reach by the fingertip of thumb 101, the operator can easily operation traveling of bulldozer 10 by appropriately pressing first to third operation switches 71 to 73 with the inside (where the fingerprint is present) of the finger tip of thumb 101.

While operation of first to third operation switches 71 to 73 is paused, an operator can rest thumb 101 on finger rest 66. As compared with the conventional shape of hold portion 62 that the operator grasps in the five fingers of the left hand rest around hold portion 62, operation device 60 of the present embodiment provides a shorter distance by which thumb 101 is moved. In order for left hand 100 in the posture of grasping hold portion 62 to operate first to third operation switches 71 to 73, the operator has to release the hand and then move thumb 101 to first to third operation switches 71 to 73. In contrast, in the case of operation device 60 of the present embodiment, first to third operation switches 71 to 73 can be operated by moving thumb 101 by a slight distance from finger rest 66 to first to third operation switches 71 to 73. Accordingly, the operability of operation device 60 can be improved.

In the case where a shift has to be made frequently between first to third operation switches 71 to 73 on conventional operation device 60 in which no finger rest 66 is formed, an operator has to be on standby with thumb 101 kept in the air in the vicinity of operation portion 63. In contrast, in the case of operation device 60 of the present embodiment, an operator can rest thumb 101 on finger rest 66 so that thumb 101 can be in the posture of being supported by finger rest 66, while a shift is made between first to third operation switches 71 to 73. Therefore, the burden on the operator while a shift is made between a plurality of operation switches can be lessened and the ease to use operation device 60 can be improved.

Moreover, as shown in FIG. 7, length L1 representing the minimum value of the dimension of finger rest 66 in the direction orthogonal to the direction in which finger rest 66 extends is larger than length L2 representing the minimum value of the distance between operation face 72*a* of second operation switch 72 and operation face 73*a* of third operation switch 73. This ensures that an operator can rest thumb 101 on finger rest 66. Moreover, since second operation switch 72 and third operation switch 73 are disposed adjacent to each other, the operator can easily operate both second operation switch 72 and third operation switch 73.

Moreover, as shown in FIG. 7, length L1 representing the minimum value of the dimension of finger rest 66 in the direction orthogonal to the direction in which finger rest 66 extends is larger than diameter D1 of operation face 72*a* of second operation switch 72, larger than diameter D2 of operation face 73*a* of third operation switch 73, and larger than minor axis D3 which is the transverse length passing through the center of the operation face of first operation switch 71. This ensures that an operator can rest thumb 101 on finger rest 66. Moreover, since the upper limit of the transverse length passing through the center of the operation face of each of a plurality of operation switches 71 to 73 is defined, operation portion 63 can be reduced in size.

Moreover, as shown in FIGS. 3 and 5, finger rest 66 has the shape of a depression formed in the surface of operation portion 63. Finger rest 66 can thus be formed to implement ergonomically excellent operation device 60 adapted to the shape of thumb 101 of an operator.

The shape of finger rest 66 is not limited to the shape of the depression shown in the drawings. For example, finger rest 66 may be in the shape of a groove formed in the surface of operation portion 63, a grain shape defined by minute projections and depressions, or the shape of a step. Finger rest 66 may be formed in any shape as long as thumb 101 of an operator placed on finger rest 66 is less likely to be released from finger rest 66 and thumb 101 of the operator can comfortably be received in finger rest 66.

Moreover, as shown in FIG. 5, finger rest 66 has a portion formed lower than top end 67 of hold portion 62. Thus, the shape is implemented that enables thumb 101 to be rest easily on finger rest 66 while the operator assumes the posture of holding hold portion 62 in the palm of left hand 101.

Moreover, as shown in FIG. 5, finger rest 66 is formed at a position crossing the line represented by the two-dot chain line shown in FIG. 5 connecting the center of base end 65 of hold portion 62 and the center of leading end 64 of hold portion 62 when hold portion 62 is seen from the side where finger rest 66 is formed in operation portion 63. Thus, the shape is implemented that enables thumb 101 to be rest easily on finger rest 66 while the operator assumes the posture of holding hold portion 62 in the palm of left hand 101.

Moreover, as shown in FIG. 6, first to third operation switches 71 to 73 are arranged on circle C having center O at leading end 64 of hold portion 62 as seen from the side where first to third operation switches 71 to 73 are mounted. Since all of a plurality of operation switches 71 to 73 are arranged in the circumferential direction of the same circle C, erroneous operation of a switch, which is different from any of a plurality of operation switches 71 to 73 to be operated, can be suppressed.

Moreover, as shown in FIG. 6, third operation switch 73 is disposed at a shorter distance from center O of circle C than the distance from center C to first operation switch 71 and than the distance from center C to second operation switch 72. Among three operation switches 71 to 73, third operation switch 73 located at the lowest position is disposed to adapt to movement of the joints of the wrist and the thumb when the operator operates third operation switch 73. Third operation switch 73 is disposed to adapt to the trajectory of the fingertip of thumb 101 when the operator shifts thumb 101. The disposition of third operation switch 73 can thus be adjusted to facilitate operation of third operation switch 73. Accordingly, the operability of third operation switch 73 can be improved.

Moreover, as shown in FIG. 8, one surface 74 on which first operation switch 71 is mounted inclines with respect to the other surface 75 on which second and third operation switches 72, 73 are mounted, so that the dimension of a portion protruding from the other surface 75 increases as the distance from hold portion 62 increases. In this way, operation of the operation switch disposed away from hold portion 62 is facilitated. Accordingly, the operation of making a switch between the forward travel and the rearward travel of bulldozer 10 by first operation switch 71 is facilitated, and the operability of first operation switch 71 can be improved.

Moreover, as shown in FIG. 4, protrusion 69 is formed at base end 65 of hold portion 62. Protrusion 69 is a surface of base end 65 protruding toward the side from which hold portion 62 is seen when operation device 60 is seen from the side where finger rest 66 is formed in operation portion 63. A smooth depression of the surface of hold portion 62 is formed directly on protrusion 69 by forming protrusion 69. An operator holding hold portion 62 can rest the palm of left hand 100 on this depression. Thus, ergonomically excellent operation device 60 adapted to the shape of left hand 100 of the operator can be implemented.

The above embodiment has been described regarding the example where first operation switch 71 is mounted on one surface of operation portion 63 and second operation switch 72 and third operation switch 73 are mounted on the other surface 75 thereof. The disposition of a plurality of operation switches 71 to 73, however, is not limited to this example. For example, second operation switch 72 and third operation switch 73 may be mounted on one surface 74 of operation portion 63 and first operation switch 71 may be mounted on the other surface 75 thereof. A plurality of operation switches 71 to 73 are not limited to the illustrated rocker switch or push switch, and may be any kind of switch.

The above embodiment has been described regarding operation device 60 for controlling the forward travel and the backward travel of bulldozer 10. Operator's seat 31 is disposed with median line ML inclined so that an operator sitting on operator's seat 31 can easily see frontward and rearward. Operator's seat 31 is not limited to this configuration. Operator's seat 31 may be configured not to be inclined with respect to the front-rear direction, and operator's seat 31 may be configured to be rotatable as seen in plan view. Operation device 60 of the above embodiment may be mounted on any of other work vehicles. Operation device 60 may be configured as a device for performing any operation of the work vehicle on which operation device 60 is mounted.

It should be construed that the embodiments disclosed herein are given by way of illustration in all respects, not by way of limitation. It is intended that the scope of the present invention is defined by claims, not by the description above, and encompasses all modifications and variations equivalent in meaning and scope to the claims.

REFERENCE SIGNS LIST

9 cab; 10 bulldozer; 31 operator's seat; 44 left console; 45 left armrest; 60 operation device; 61 base portion; 62 hold portion; 63 operation portion; 64 leading end; 65 base end; 66 finger rest; 67 top end; 69 protrusion; 71 first operation switch; 72 second operation switch; 72*a*, 73*a* operation face; 73 third operation switch; 74 one surface; 75 the other surface; 91, 92 operation lever; 100 left hand; 101 thumb; C circle; D1, D2 diameter; D3 minor axis; EL direction in which hold portion extends; L1, L2 length; O center

The invention claimed is:

1. An operation device of a work vehicle, the operation device comprising:

a hold portion configured to be held in a palm of one hand of an operator operating the operation device, the hold portion being formed in a curved rod-shape, the hold portion including a base end and a leading end opposite to the base end, the hold portion being attached to the work vehicle at the base end; and an operation portion cantilevered by the leading end of the hold portion, the operation portion including:

a first operation switch, a second operation switch disposed below the first operation switch, and a third operation switch disposed below the second operation switch, the first, second, and third operation switches configured to control travel of the work vehicle and to be operated by a finger of the operator; and a first surface and a second surface, the first surface being separated from the second surface, the first and second surfaces having a flat shape, and the first operation switch being disposed on the first surface and the second and the third operation switches being disposed on the second surface.

2. The operation device of a work vehicle according to claim 1, wherein the first surface is inclined with respect to the second surface so that a dimension of a portion protruding from the second surface increases as a distance from the hold portion increases.

3. The operation device of a work vehicle according to claim 1, wherein a protrusion is formed at the base end of the hold portion, the protrusion being a surface of the base end protruding toward a side from which the hold portion is seen when the operation device is seen from a side where the at least three operation switches are disposed.

4. The operation device of a work vehicle according to claim 1, wherein the first surface and the second surface of the operation portion face a seat of the operator.

5. The operation device of a work vehicle according to claim 1, wherein the first of the at least three operation switches is for switching between forward travel and backward travel of the work vehicle, the second of the at least three operation switches is for shifting gears of a transmission of the work vehicle, and a third of the at least three operation switches is for shifting gears of the transmission of the work vehicle.

6. The operation device of a work vehicle according to claim 1, wherein the operation portion comprises a protruding part that protrudes downward from the leading end of the hold portion, the protruding part comprising at least one of the at least three operation switches.

* * * * *